US008171671B2

(12) United States Patent
Gallenschütz

(10) Patent No.: US 8,171,671 B2
(45) Date of Patent: May 8, 2012

(54) SECURITY GATE

(76) Inventor: Thomas Gallenschütz, Bühl (DE)

( * ) Notice: Subject to any disclaimer, the term of this patent is extended or adjusted under 35 U.S.C. 154(b) by 690 days.

(21) Appl. No.: 11/922,127

(22) PCT Filed: Jun. 20, 2006

(86) PCT No.: PCT/EP2006/005904
§ 371 (c)(1),
(2), (4) Date: Dec. 13, 2007

(87) PCT Pub. No.: WO2006/136370
PCT Pub. Date: Dec. 28, 2006

(65) Prior Publication Data

US 2009/0312873 A1 Dec. 17, 2009

(30) Foreign Application Priority Data

Jun. 20, 2005 (DE) ..... 10 2005 028 712

(51) Int. Cl.
*E06B 11/08* (2006.01)

(52) U.S. Cl. ..... 49/47; 49/42; 49/44; 109/8

(58) Field of Classification Search ..... 49/42, 44, 49/46, 47, 506; 109/6, 7, 8
See application file for complete search history.

(56) References Cited

U.S. PATENT DOCUMENTS

| | | | | |
|---|---|---|---|---|
| 2,144,718 | A | 1/1939 | Gersbach | |
| 3,525,176 | A * | 8/1970 | Collins | 49/46 |
| 5,355,630 | A | 10/1994 | Kocznar et al. | |
| 5,471,795 | A * | 12/1995 | Gallenschutz et al. | 49/506 |
| 5,605,015 | A * | 2/1997 | Uhl et al. | 49/47 |
| 6,065,246 | A * | 5/2000 | Detassis | 49/47 |
| 6,715,234 | B1 * | 4/2004 | Libardi | 49/42 |
| 7,627,984 | B2 * | 12/2009 | Wallerstorfer | 49/47 |
| 7,703,241 | B2 * | 4/2010 | Eshel et al. | 49/42 |
| 2004/0006919 | A1 * | 1/2004 | Wild | 49/42 |
| 2006/0218863 | A1 * | 10/2006 | Eshel et al. | 49/49 |
| 2007/0277439 | A1 * | 12/2007 | Ponert et al. | 49/44 |

FOREIGN PATENT DOCUMENTS

| | | |
|---|---|---|
| CN | 2625554 | 7/2004 |
| DE | 336 361 | 4/1921 |
| DE | 28 25 787 | 12/1979 |
| EP | 0 552 332 | 7/1993 |
| GB | 2 186 618 | 8/1987 |
| WO | WO 93/03251 | 2/1993 |

OTHER PUBLICATIONS

International Search Report.

* cited by examiner

*Primary Examiner* — Katherine W Mitchell
*Assistant Examiner* — Catherine A Kelly
(74) *Attorney, Agent, or Firm* — Collard & Roe, P.C.

(57) ABSTRACT

The invention relates to an access lock for cyclically permitting people to pass through. The access lock has at least two locking elements (12, 14), with each of the locking elements (12, 14) being movable, independently of the respective other locking element (14, 12), on a closed path between a locked position which locks the passage at a locking point and an open position which opens the passage.

18 Claims, 3 Drawing Sheets

SECURITY GATE

CROSS REFERENCE TO RELATED APPLICATIONS

Figure 1:
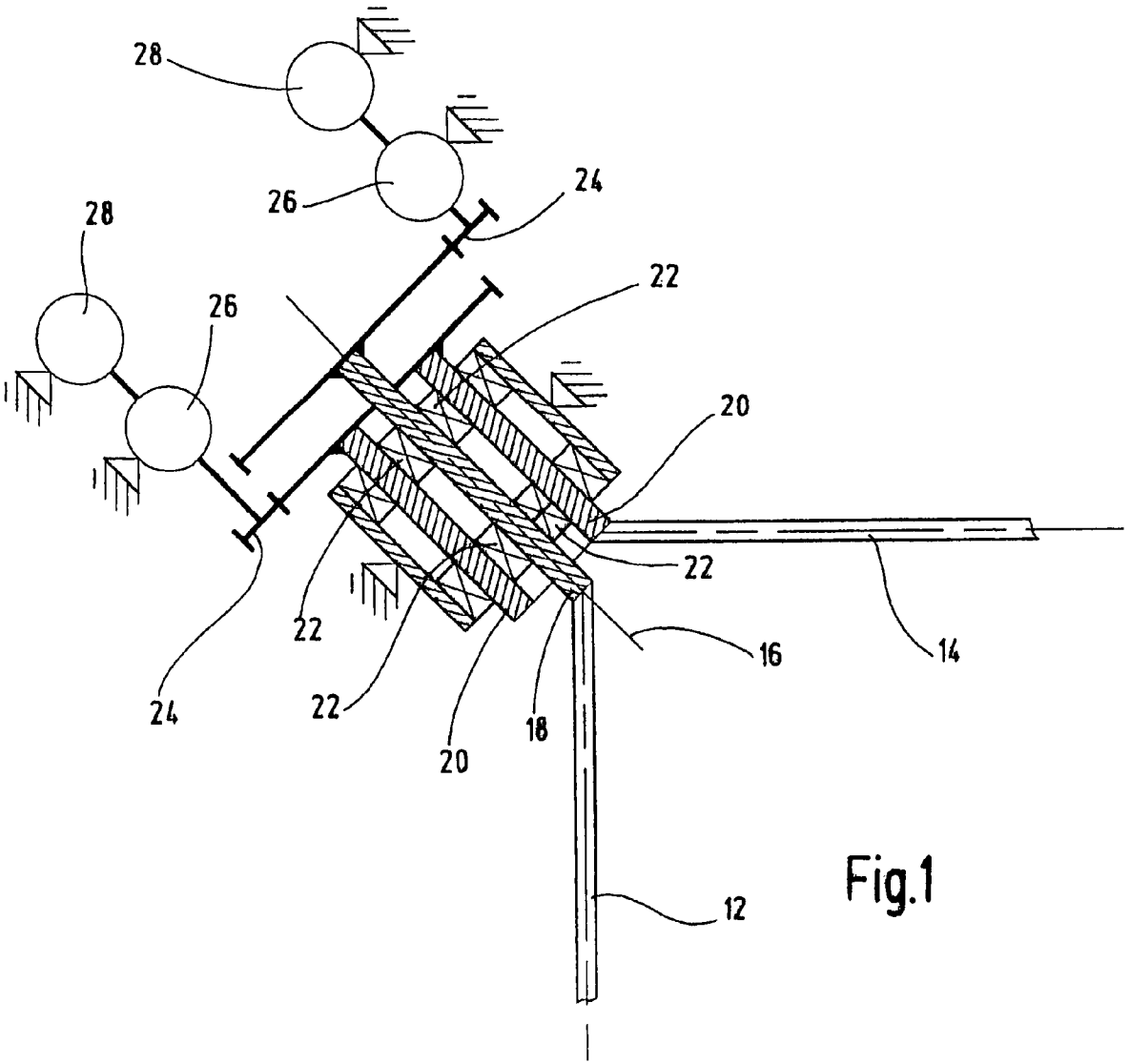

Applicant claims priority under 35 U.S.C. §119 of German Application No. 10 2005 028 712.3 filed Jun. 20, 2005. Applicant also claims priority under 35 U.S.C. §365 of PCT/EP2006/005904 filed Jun. 20, 2006. The international application under PCT article 21(2) was not published in English.

The invention relates to a security gate for cyclical release, permitting persons to pass through.

Such a security gate, equipped with a turnstile, is known, for example, from EP 0 552 332 B1. There, a turnstile is described, which has three barrier crosspieces disposed on a common carrier and rigidly connected with one another. This has the disadvantage that the passage of the security gate that is blocked by this turnstile cannot be completely opened up. In case of an emergency or a panic, however, it is practical to completely open up the security gate, in addition to other emergency exits that might be present. In the case of the known turnstile, this is not possible, because one of the barrier crosspieces always projects into the passage. From DE 28 25 787 C3, a turnstile is known that makes it possible to open up the passage of the security gate in case of an emergency. For this purpose, the barrier crosspieces are attached to the carrier so that they can be folded down, so that the barrier crosspiece that is situated in the barrier position can be folded down, in case of an emergency, thereby opening up the passage. This solution is technically complicated, requires a large number of components, and is therefore correspondingly expensive to produce.

It is therefore the task of the invention to further develop a security gate of the type stated initially, in such a manner that the passage can be opened up in simple manner if necessary.

This task is accomplished, according to the invention, by means of a security gate having the characteristics of claim 1. Advantageous further developments are the object of the dependent claims. The security gate can have a turnstile, a carrousel door, or the like, whereby passing through is prevented by means of barrier crosspieces, grids, doors, or similar barrier elements. The passage is opened up in that the barrier elements leave their barrier position, in the pass-through direction. In this connection, they move from the barrier position into the pass-through position, and back into the barrier position, on a closed track. In the barrier position, each barrier element prevents passing through at the same barrier location. The configuration of the security gate with a turnstile, in accordance with claim 2, is particularly preferred.

The invention is based on the idea that the at least two barrier elements, particularly the barrier crosspieces of the turnstile, are not rigidly connected with one another. As a result, they can preferably be rotated, relative to one another, about a common axis of rotation. If necessary, for example in an emergency, only the barrier crosspiece that is in the barrier position at the barrier location can then be rotated until it reaches a pass-through position, while the other barrier crosspieces, which are in a pass-through position, remain in their position. Rotation of one of the barrier crosspieces out of its barrier position therefore does not necessarily cause another barrier crosspiece to be moved into the barrier position, in turn preventing persons from passing through, as is the case with known security gates.

Preferably, each barrier crosspiece is rigidly affixed to a carrier, and each carrier can be rotated about the common axis of rotation, relative to every other carrier. It is practical if each carrier can be rotated about the common axis of rotation by means of a motor, by way of a gear mechanism. The movement of the barrier crosspieces can therefore be separately controlled for every barrier crosspiece. For this purpose, it is practical if the motors can be controlled by means of a control unit. Preferably, the turnstile has a reader unit for admission tickets and the like, which unit generates a signal from data obtained from reading the admission tickets, and passes this signal on to the control unit. The control unit individually turns on the motors for rotation of the individual barrier crosspieces, as a function of the signal from the reader unit. Spur gear mechanisms or belt mechanisms having belt pulleys and belts can be used as gear mechanisms. However, it is preferred that at least one of the gear mechanisms is a chain gear mechanism having a first gear wheel connected with the carrier, a second gear wheel connected with a drive shaft, and a chain that is stretched over the gear wheels.

According to an advantageous further development of the invention, each of the carriers has cams that project radially towards the outside, and locking levers mounted to be fixed in place are provided, which can be pivoted into a position that prevents a rotational movement of the carriers, by means of coming to rest against the cams. In this connection, it is advantageous if a locking lever is provided for each direction of rotation of each carrier. Rotation of the barrier crosspieces can be prevented as necessary by means of the locking levers, for example if the reader unit recognizes a forged admission ticket.

It is practical if the barrier crosspieces are inclined, with regard to the axis of rotation, by an angle between 30° and 60°, preferably 45°. Preferably, the axis of rotation is inclined, relative to the horizontal, by the same angle as the barrier crosspiece is inclined relative to the axis of rotation. Particularly in the case of an incline of 45°, in the case of a turnstile having two crosspieces, one barrier crosspiece stands horizontal in the barrier position, while a second barrier crosspiece points vertically downward, in the pass-through position.

In order to detect the rotational movement of the barrier crosspieces, the turnstile can have sensors. The sensors report any rotational movements that have been detected to the control unit, which controls the motors as a function of the current direction of rotation and speed of rotation of the barrier crosspieces.

Several variants for controlling the turnstile described above are possible. For example, it is possible to release at least one barrier crosspiece situated in the barrier position when an alarm signal is passed to the control unit, for example a signal triggered manually, so that the crosspiece can be freely rotated about the axis of rotation. The barrier crosspiece does remain in the barrier position, but can be rotated into the pass-through position, without any great expenditure of force, by a person passing through the security gate. Alternatively, it is possible that when such an alarm signal is passed to the control unit, all of the barrier crosspieces are rotated into the pass-through position, by means of the motors being turned on by the control unit. When such an alarm signal is received by the control unit, the passage is then automatically opened up.

An advantageous method for controlling the turnstile provides that the reader unit, after having read a valid admission ticket, sends a release signal to the control unit, and the control unit controls the motors in such a manner that first, a first barrier crosspiece situated in a pass-through position is rotated by a predetermined angle, after which a second barrier crosspiece situated in a barrier position is rotated into a pass-through position, and the first barrier crosspiece is rotated into a barrier position. In this connection, the second barrier crosspiece can be rotated into the pass-through position when a sensor detects a movement of the second barrier crosspiece, and sends a corresponding signal to the control unit. The movement of the second barrier crosspiece can come about in that a person interprets the rotation of the first barrier crosspiece by the predetermined angle as an indication that the passage is now open, and presses against the second barrier crosspiece, deflecting it out of the barrier position by a short path.

If a sensor detects a rotation of one of the barrier crosspieces in a direction of rotation that is not released, and sends a corresponding signal to the control unit, it can be provided that the locking levers are pivoted into the position in which they block the rotational movement of the carriers. In this way, the turnstile can be prevented from rotating if a person attempts to pass through the security gate in the wrong direction, and to rotate a barrier crosspiece that has already been released in a direction for which no release has been given.

Figure 2:
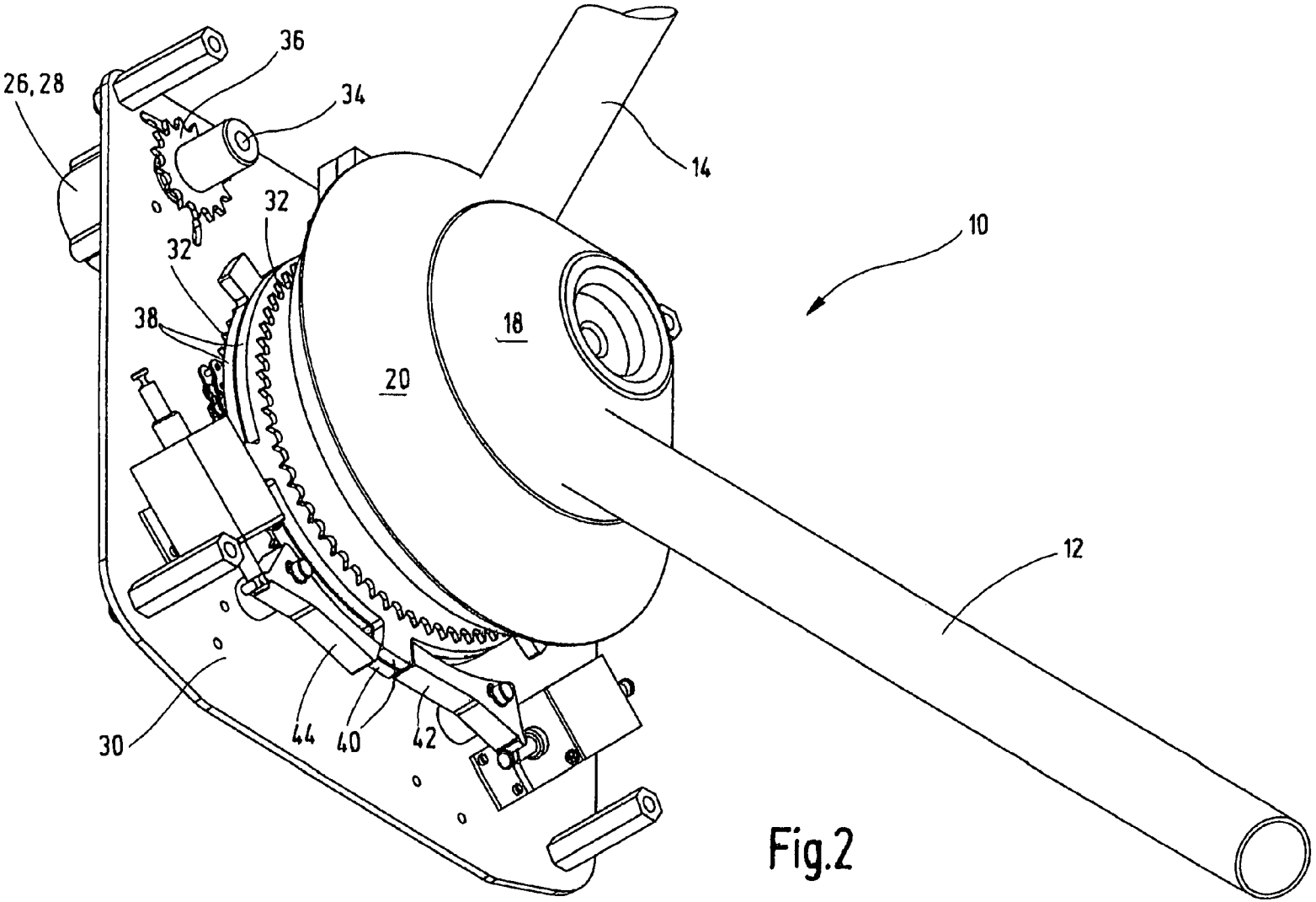
Figure 3:
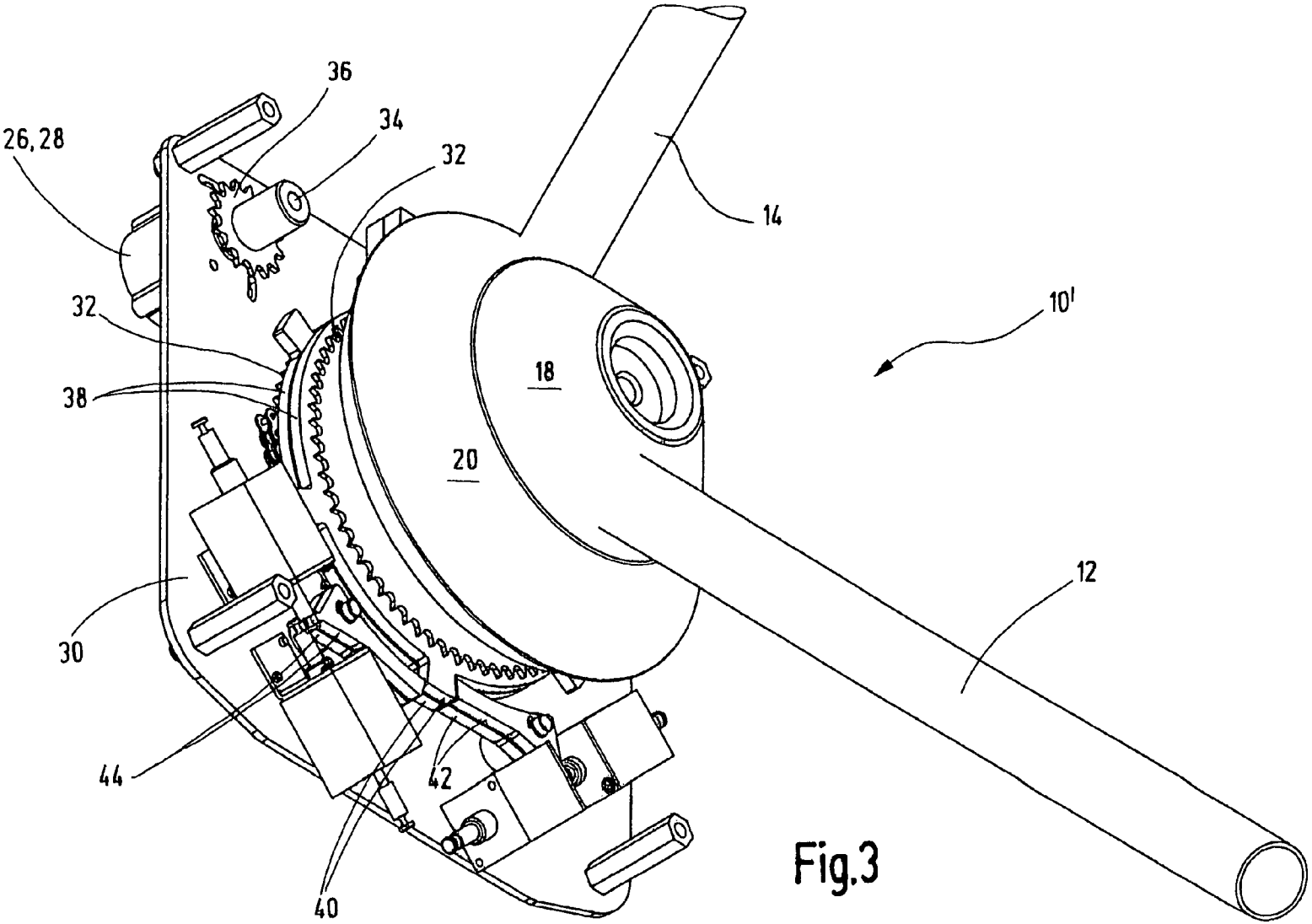

In the following, the invention will be explained in greater detail using an exemplary embodiment shown schematically in the drawing. This shows FIG. 1 a schematic representation of a turnstile;

FIG. 2 a perspective representation of a turnstile according to a first exemplary embodiment; and FIG. 3 a perspective representation of a turnstile according to a second exemplary embodiment.

According to the exemplary embodiments, a turnstile 10, 10' for a security gate has two barrier crosspieces 12, 14. These are positioned in such a manner, in the case of the arrangement shown schematically in FIG. 1, that a first barrier crosspiece 12 assumes a pass-through position, in which it points vertically downward, while a second barrier crosspiece 14 assumes a barrier position, in which it projects horizontally into the passage of the security gate, at a barrier location, and blocks the way. The two barrier crosspieces 12, 14 can be rotated about a common axis of rotation 16. The axis of rotation 16 is inclined at an angle of 45° relative to the horizontal. The barrier crosspieces 12, 14 also enclose an angle of 45° with the axis of rotation 16, in each instance. The first barrier crosspiece 12 is affixed to a first carrier 18, the second barrier crosspiece 14 is affixed to a second carrier 20. The two carriers 18, 20 are disposed concentrically about the axis of rotation 16, and can be rotated about the latter. Furthermore, the carriers 18, 20 can also be rotated about the axis of rotation 16 relative to one another. For this purpose, a bearing 22 is disposed between the carriers 18, 20. Each of the carriers 18, 20 is connected with a motor 26 and a brake 28, by way of a gear mechanism 24. The motors 26 and the brakes 28 are affixed to a frame 30 (FIG. 2, 3), which is mounted to be fixed in place, and through which the axis of rotation 16 also passes. The axis of rotation 16 is therefore also fixed in place. The brakes 28 can act with force fit and/or with shape fit, and can be configured as disk brakes or as cable brakes, for example. As shown in FIG. 1, they can be disposed on the axles of the motors 26, or alternatively, on the axles of the carriers 18, 20.

The gear mechanisms 24 each have a first gear wheel 32 rigidly connected with one of the carriers 18, 20, a second gear wheel 36 rigidly connected with a drive shaft 34 of one of the motors 26, as well as a chain (not shown) stretched over the gear wheels 32, 36. Furthermore, each carrier 18, 20 has a disk 38 in the shape of a circular ring rigidly connected with it, from which cams 40 project at regular angle intervals (60° in FIG. 2). According to the first exemplary embodiment (FIG. 2), two locking levers 42, 44 are affixed to the frame 30 so as to pivot. The locking levers 42, 44 serve to prevent a rotational movement of the carriers 18, 20, i.e. of the barrier crosspieces 12, 14, if necessary. For this purpose, they are brought into a position in which the cams 40 make contact against the locking levers 42, 44 if the carriers 18, 20 are rotated. A first locking lever 42 serves to prevent the rotational movement in a first direction of rotation, while a second locking lever 44 serves to prevent the rotational movement in a second direction of rotation, opposite the first direction of rotation.

The turnstile 10' according to the second exemplary embodiment (FIG. 3) differs from the turnstile 10 shown in FIG. 2 only in that four locking levers 42, 44 are present in place of two locking levers. A locking lever 42 that can prevent rotation of the ring 38 and thereby of the carrier 18, 20 connected with the ring 38, in the first direction of rotation, is affixed on the frame 30 for each of the rings 38, as is a second locking lever 44 for preventing the rotational movement of the ring 38 in the second direction of rotation.

If the turnstile 10, 10' according to FIG. 2 or 3 is installed in a security gate, the gear mechanisms 24, the rings 38, and the locking levers 42, 44 as well as the motors 26 and the brakes 28 are covered by means of a housing.

The method of operation of the turnstile 10, 10' is now as follows:

An admission ticket, ticket for travel, or a similar card that can be read by machine, i.e. electronically, is put into a reader unit and read there. If data is stored on it, according to which the turnstile 10, 10' is to be opened, the reader unit transmits a release signal to a control unit for turning the motors 26 on. In order to indicate to the user that the turnstile 10 has been released, the barrier crosspiece 12 or 14 that is in the pass-through position at the time is first rotated by a predetermined angle. When the user presses against the barrier crosspiece 14 or 12 and deflects it slightly out of its barrier position, this movement is detected by a sensor and transmitted to the control unit. On the basis of this signal, the barrier crosspiece is rotated out of the barrier position into the pass-through position by turning on one of the motors 26, while the barrier crosspiece that was previously in the pass-through position is rotated into the barrier position at the barrier location. Once they have arrived at their new positions, the barrier crosspieces 12, 14 are braked in their rotational movement by the brakes 28, and held in position. If it is feared that a person might try to obtain unauthorized access, for example in the wrong direction, the locking levers 42, 44 are pivoted into their position in which they prevent rotation of the rings 38. This occurs, in particular, if a sensor detects rotation of one of the barrier crosspieces 12, 14 in a direction for which no release has been given. The sensor sends a signal to the control unit, which in turn turns on the locking levers 42, 44. Likewise, the locking levers 42, 44 are turned on by the control unit if the latter receives a signal from the reader unit that an invalid admission ticket or ticket for travel was read.

If the passage through the security gate must be opened in an emergency, a corresponding signal is sent to the control unit. This takes place, for example, by means of an alarm triggered by a security service, a smoke alarm, or in similar manner. In this case, the motors 26 and the brakes 28 are controlled by the control unit in such a manner that the barrier crosspiece that is situated in the pass-through position remains there, while the other barrier crosspiece, which is situated in the barrier position, is also rotated into the pass-through position, in which it points vertically downward.

In summary, the following should be stated:

The invention relates to a security gate for cyclical release, permitting persons to pass through. The security gate has at least two barrier elements 12, 14, whereby each of the barrier elements 12, 14 can be moved, independent of the other barrier element 14, 12, in each instance, on a closed track, between a barrier position that prevents passage at a barrier location, and a pass-through position that permits passage.

The invention claimed is:

1. Security gate for cyclical release, permitting persons to pass through, having at least two barrier crosspieces, wherein each barrier crosspiece of the at least two barrier crosspieces can be rotated about a common axis of rotation, the common axis being locally fixed, and wherein each barrier crosspiece of the at least two barrier crosspieces can be rotated about the common axis of rotation independent of the other barrier crosspiece of the at least two barrier crosspieces, in each instance, the at least one of the independently rotatable barrier crosspieces having a first blocking position that selectively permits passage and a second non-blocking position independent of the other barrier crosspiece that permits free passage.

2. Security gate according to claim 1, wherein the at least two barrier elements comprise at least two barrier crosspieces, whereby each barrier crosspiece can be rotated, independent of the other barrier crosspiece, in each instance, about a locally fixed axis of rotation, between the blocking position and the non-blocking position.

3. Security gate according to claim 2, wherein the barrier crosspieces are disposed on a turnstile and have a common axis of rotation about which they can be rotated, relative to one another.

4. Security gate according to claim 2, wherein each barrier crosspiece is rigidly affixed to a respective carrier and wherein every carrier can be rotated about a common axis of rotation, relative to every other carrier.

5. Security gate according to claim 4, wherein each carrier can be rotated about the common axis of rotation via a motor, by way of a gear mechanism.

6. Security gate according to claim 5, wherein the motors can be turned on via a control unit.

7. Security gate according to claim 6, comprising a scanner unit, to generate a signal from information obtained by scanning, which signal can be transmitted to the control unit.

8. Security gate according to claim 5, wherein at least one of the gear mechanisms is a chain gear mechanism having a first gear wheel connected with one of the carriers, a second gear wheel connected with a drive shaft, and a chain stretched over the gear wheels.

9. Security gate according to claim 4, wherein each of the carriers has cams that project radially outward, and that locking levers mounted to be fixed in place are provided, which can be pivoted into a position in which they prevent a rotational movement of the carriers, by coming to rest against the cams.

10. Security gate according to claim 9, comprising a locking lever is provided for each direction of rotation of each carrier.

11. Security gate according to claim 2, wherein each barrier crosspiece is inclined, relative to the axis of rotation, by an angle between 30° and 60°.

12. Security gate according to claim 11, wherein the axis of rotation is inclined, relative to the horizontal, by the same angle as the barrier crosspieces are inclined relative to the axis of rotation.

13. Security gate according to claim 6, comprising sensors for detecting rotational movements of the barrier crosspieces and for transmitting the detected rotational movements to the control unit.

14. Method for controlling a turnstile of a security gate according to claim 2, wherein when an alarm signal is passed to a control unit, at least one barrier crosspiece situated in the blocking position is released and can be freely rotated about the axis of rotation.

15. Method for controlling a turnstile of a security gate according to claim 6, wherein when an alarm signal is passed to the control unit, all of the barrier crosspieces are rotated into the non-blocking position, by means of the motors being turned on by the control unit.

16. Method for controlling a turnstile of a security gate according to claim 7, wherein the scanner unit after scanning a valid entry ticket sends a release signal to the control unit, and wherein the control unit controls the motors in such a way that initially a first barrier crosspiece situated in the non-blocking position is rotated by a predetermined angle, after which a second barrier crosspiece situated in the blocking position is rotated into the non-blocking position, and the first barrier crosspiece is rotated into the blocking position.

17. Method according to claim 16, wherein the second barrier crosspiece is rotated into the non-blocking position if a sensor detects a movement of the second barrier crosspiece and sends a corresponding signal to the control unit.

18. Method for controlling a turnstile of a security gate according to claim 9, wherein the locking levers are pivoted into the position preventing the rotational movement of the carriers whenever a sensor detects a rotation of one of the barrier crosspieces in a non-released direction of rotation and sends a corresponding signal to the control unit.

* * * * *